United States Patent [19]

Owens

[11] Patent Number: 4,728,910

[45] Date of Patent: Mar. 1, 1988

[54] FOLDED WAVEGUIDE COUPLER

[75] Inventor: Thomas L. Owens, Kingston, Tenn.

[73] Assignee: The United States of America as represented by the United States Department of Energy, Washington, D.C.

[21] Appl. No.: 923,540

[22] Filed: Oct. 27, 1986

[51] Int. Cl.[4] ..... H01P 5/00

[52] U.S. Cl. ..... 333/24 R; 219/10.55 A; 333/248; 333/99 PL

[58] Field of Search ..... 333/24 R, 239, 99 PL, 333/248; 219/10.55 R, 10.55 A, 121 P

[56] References Cited

U.S. PATENT DOCUMENTS

| | | | |
|---|---|---|---|
| 2,281,552 | 5/1942 | Barrow | 333/239 |
| 3,851,131 | 11/1974 | Johnston et al. | 333/24 R X |
| 4,241,323 | 12/1980 | Griffin et al. | 333/248 X |

OTHER PUBLICATIONS

W. L. Barrow et al, "Hollow Pipes of Relatively Small Dimensions," AIEE Transactions, Mar. 1941, vol. 60, pp. 119–122.

T. L. Owens et al, "New Developments in Waveguide and Loop Coupler Technology for ICRF Heating," Bulletin of the APS Series II, vol. 30, No. 9, Oct. 1985, p. 1589.

*Primary Examiner*—Paul Gensler

*Attorney, Agent, or Firm*—David E. Breeder; Stephen D. Hamel; Jusdon R. Hightower

[57] ABSTRACT

A resonant cavity waveguide coupler for ICRH of a magnetically confined plasma. The coupler consists of a series of inter-leaved metallic vanes disposed within an enclosure analogous to a very wide, simple rectangular waveguide that has been "folded" several times. At the mouth of the coupler, a polarizing plate is provided which has coupling apertures aligned with selected folds of the waveguide through which rf waves are launched with magnetic fields of the waves aligned in parallel with the magnetic fields confining the plasma being heated to provide coupling to the fast magnetosonic wave within the plasma in the frequency usage of from about 50–200 mHz. A shorting plate terminates the back of the cavity at a distance approximately equal to one-half the guide wavelength from the mouth of the coupler to ensure that the electric field of the waves launched through the polarizing plate apertures are small while the magnetic field is near a maximum. Power is fed into the coupler folded cavity by means of an input coaxial line feed arrangement at a point which provides an impedance match between the cavity and the coaxial input line.

9 Claims, 5 Drawing Figures

FOLDED WAVEGUIDE COUPLER

BACKGROUND OF THE INVENTION

This invention, which is a result of a contract with the United States Department of Energy, relates generally to microwave energy coupling devices and more specifically to a microwave coupling device for launching microwave power into a magnetically confined plasma.

In controlled fusion devices, it is important to efficiently couple multiple megawatts of radio frequency (rf) power in the approximate frequency range of 50–200 MHz into the confined plasma to heat the plasma. These high-frequency waves are generated in an oscillator outside a vacuum vessel containing the magnetically confined plasma and transmitted to a launcher inside the vacuum environment by means of a coaxial line. If the waves have particular frequencies, part of their energy can be transferred to the nuclei or electrons in the plasma. These higher energy particles then collide with other particles and thereby increase the plasma temperature.

In ion cyclotron resonance heating (ICRH), the frequency of the energy source is adjusted to be roughly equal to the frequency at which the ions in the plasma spiral about the magnetic field lines containing the plasma. The ions acquire energy from the rf waves and share it with other particles forming the plasma by collisons. ICRH is generally preferred over electron cyclotron resonance heating because the frequency for a given magnetic field strength is lower due to the lower mass of ions.

As the heating demands of medium and large fusion devices increase, such as the Tore Supra Tokamak in France, for example, greater power handling demands over long periods of operation are placed on the devices used to launch the rf power into the plasma. Due to the limited size and number of access ports to the plasma as the confinement design become more compact, smaller structures for launching rf power into the plasma at high power and higher frequencies are required to maximize the power conveyed through each access part.

Various power coupling devices such as, inductively coupled antenna designs in the form of inductive loop couplers, ridged waveguides, cavity backed aperture couplers, and dielectrically loaded waveguides have been proposed, or used, for fusion plasma heating. However, these coupling devices have limitations of either power handling limits, coupling efficiency, plasma environment compatibility, frequency limits, voltage limitations, impedance matching, or flexibility in adapting the structure to the fusion device access ports.

Thus, it will be apparent to those skilled in the art that there is a need for an rf coupling device which overcomes the disadvantages of present rf coupling devices.

SUMMARY OF THE INVENTION

In view of the above need, it is an object of this invention to provide a radio frequency coupling device for efficient coupling of multiple megawatts of power in the frequency range of from about 50–200 MHz to a plasma in a controlled fusion device.

Another object of this invention is to provide a waveguide coupling structure as in the above object which provides increased flexibility in configuring the coupler to various size plasma access ports of different plasma confinement devices while maintaining high coupling efficiency and low voltages at the plasma/coupler interface.

Other objects and many of the attendant advantages of the present invention will be apparent from the following detailed description of the invention taken in conjunction with the drawings.

In summary, the invention is a folded waveguide coupler for ICRH heating of a magnetically confined plasma. The coupler consists of an electrically conductive housing having open ends and a plurality of interleaved metallic vanes disposed within and alternately attached to opposite side walls of the housing. Each vane extends the length of the housing and into the housing a selected distance to form a folded waveguide structure within the housing.

The mouth of the coupler is formed at the front end of the housing by covering the front end with a metal polarizing plate having openings aligned with selected alternate spaces between the vanes to produce a selected wave field polarization and wave number spectrum for the wave energy launched from the mouth of the coupler. A fixed or adjustable shorting plate is provided at the back opening of the housing to terminate the axial length of the coupler at approximately one half the guide wavelength. This assures that the electric fields at the coupler mouth are small while the magnetic fields of the wave are large. Thus, maximum coupling of the wave energy launched from the mouth of the coupler to a plasma is obtained, since plasma coupling for a magnetically confined plasma occurs primarily through the magnetic field of the wave rather than the electric field. The position of the shorting plate is determined by the constraint that the fields within the plane containing the coupling apertures are continuous across the apertures. The precise position for a particular application is then determined experimentally.

The waveguide housing forming the coupler may take various forms including a circular waveguide with an interleaved vane structure.

DETAILED DESCRIPTION OF PREFERRED EMBODIMENTS

Figure 1:
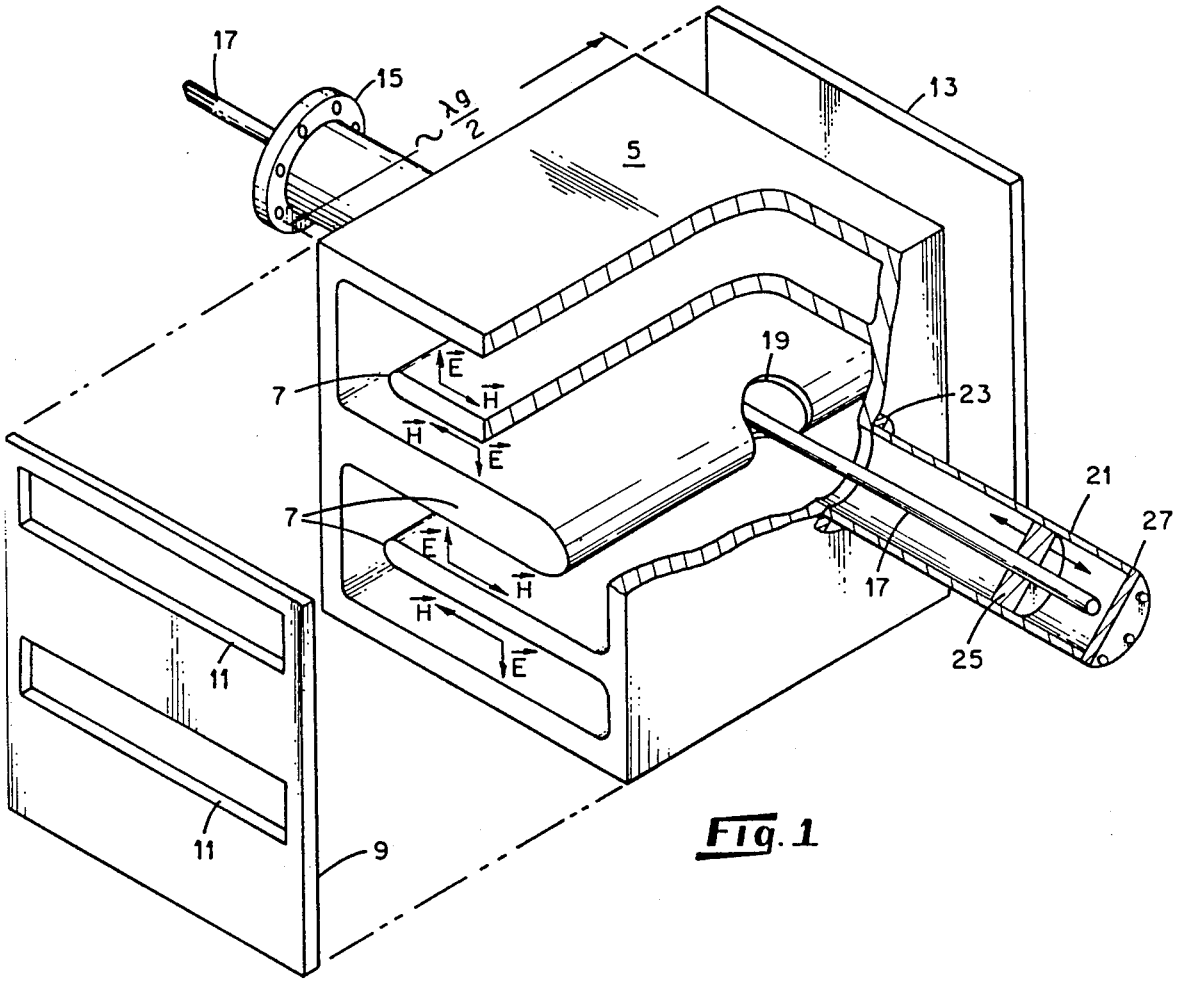
FIG. 1 is an exploded pictorial view of one embodiment of a folded waveguide coupler according to the present invention. A portion of the guide has been cut away to show the coaxial input line transition/impedance matching scheme for this embodiment.

Referring now to FIG. 1 there is shown one embodiment of a folded waveguide coupler according to the present invention. An electrically conductive rectangular housing 5 is provided which may be formed of copper, alloy hardened copper, copper plated stainless steel, or other known materials with low surface resistivity and high strength. The housing 5 includes a plurality of interleaved vanes 7 alternately attached to opposite inside walls of the housing 5 to form a folded waveguide structure. The vanes 7 extend from the respective walls where they are attached, or formed, to a distance spaced from the opposite wall corresponding to the spacing forming the height of the folded waveguide, i.e., the spacing between the parallel disposed interleaved vanes 7. The waveguide structure, minus the end plates, may be viewed as "folding" a simple rectangular waveguide cavity that has a much greater width than height in order to form a more compact structure. Cutoff for the folded waveguide occurs when one-half of a free-space wavelength equals the serpentine path length around the folds, or vanes 7, of the structure. By adding a large number of folds, or vanes, the path length around the folds can be made large, leading to very low cutoff frequencies relative to those of a simple, rectangular waveguide having comparable outside dimensions. The spacing between the interleaved vanes 7 may be altered to form, for example, a generally elliptical spherical cross section waveguide when unfolded by increasing the spacing between the vanes from the top and bottom of the guide toward the centralmost vanes as illustrated in the embodiment shown in FIG. 5.

The mouth of the coupler, the forward open end of the housing 5, as shown in FIG. 1, is covered with a metal polarizing plate 9 having rectangular openings 11 aligned, respectively, with every other fold of the waveguide structure through which polarized waves may be launched into a magnetically confined plasma spaced from the mouth of the coupler. The particular alternate folds which are opened by polarizing plate 9 depends on the desired magnetic field direction of the rf waves being launched, or coupled, into the plasma. The openings in plate 9 cause the otherwise convoluted field pattern of the folded waveguide to be substantially unidirectional. Since the wave fields normally reverse directions in adjacent folds, as illustrated by the electric (E) and magnetic (H) field vectors shown at the mouth of the waveguide 5, a cover plate of this type passes only fields having the same directionality. Fields of the opposite directionality are reflected inside the waveguide by attaching the polarizing plate to the mouth of the waveguide 5 so that it is in electrically conducting contact with the end of each vane 7 as well as the housing 5.

The back open end of the waveguide housing 5 is covered with a shorting plate 13 which is attached to the back end of housing 5 so that it is in electrically conductive contact with the back end of each vane 7 and the housing 5. Placement of this shorting plate 13 approximately one-half of a guide wavelength ($\sim\lambda g/2$) back from the mouth of the coupler ensures that the electric field E of the wave in the coupling apertures 11 of the polarizing plate 9 is small while the magnetic field H of the wave is near a maximum. Since the bulk of the rf energy is coupled to a magnetically confined plasma through magnetic fields rather than the electric fields, this is an ideal situation for maximum inductive coupling of wave energy to a plasma through the mouth of the coupler. In addition, maintaining low electric fields within the coupling aperture 11 of the polarizing plate 9 reduces the possibility of spark-over in the openings. Far greater power levels can thereby be achieved before spark-over occurs at the mouth of the coupler as compared to previous rf energy coupling devices. Further, by operating the coupler well above the cutoff frequency ($\sim 1.8\times$cutoff frequency), loss to the walls of the guide are minimized and the guide's axial dimension ($\lambda g/2$) is reasonably short (1–3 meters) for operating frequencies in the range of from about 50–200 MHz.

Input power to the folded waveguide coupler can be provided through an input coaxial line having an outer conductor coupling 15 and an inner conductor 17. Mechanical connection may be provided to a coaxial transmission line (not shown) in a conventional manner. In applications such as ICRH heating of a plasma confined in a vacuum housing where the interior of the coupler is exposed to a vacuum evironment, a coaxial vacuum feedthrough coupling may be provided between the coaxial transmission line and the input coaxial line. In either case, the outer conductor coupling is connected to the side wall of the housing 5 in alignment with an aperture 19, which in this case extends through the enlarged width central vane 7, through which the central conductor extends into the outer conductor 21 of a tuning stub sealably attached to the opposite wall of housing 5 in alignment with a corresponding size aperture 23 in the housing 5. The tuning stub may be sealed to maintain the vacuum environment by sealably covering the end of the outer conductor tube 21 with a removable cap 27.

Figure 2:
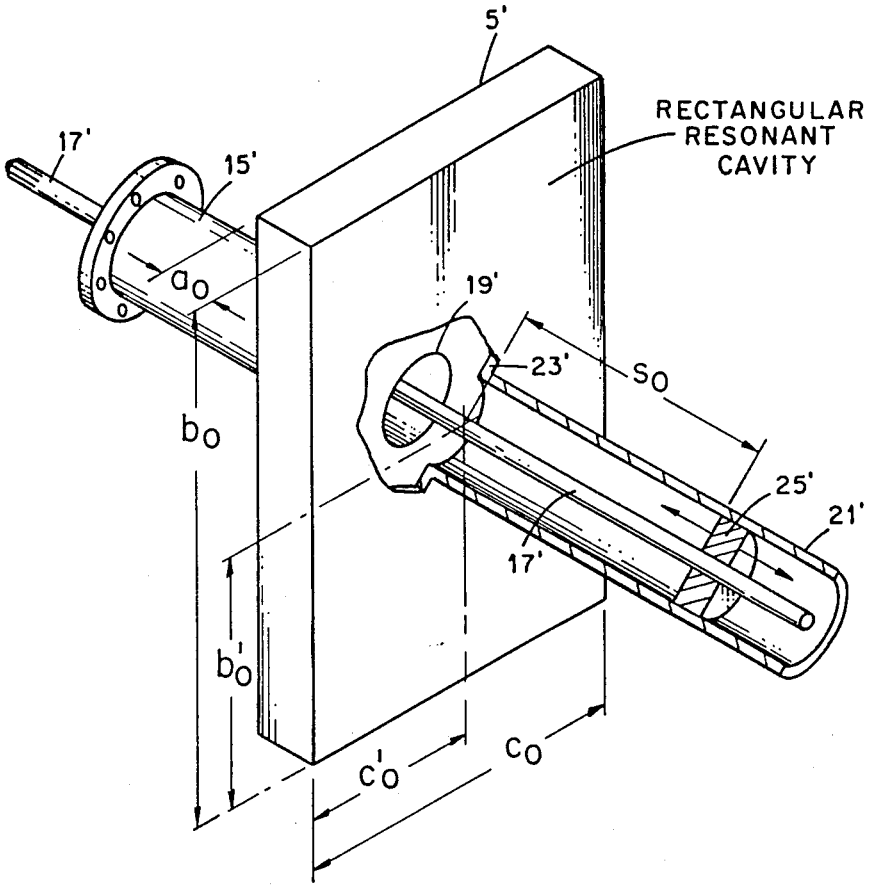
FIG. 2 ia a pictorial view of an unfolded waveguide cavity, partially cut away to illustrate the transition-/impedance matching scheme for connecting a coaxial transmission line to a rectangularresonant cavity. This scheme is used to illustrate the coax transition/impedance matching method for the folded guide of FIG. 1. This scheme may be used even though the height, $a_o$, of the cavity is small compared to the width, $C_o$, as in the case for the folded guide in FIG. 1.

A sliding short formed of an electrically conductive disk 25 having a central opening through which the fixed inner conductor 17 extends is slidably disposed within the outer conductor 21 of the tuning stub. The disk 25 is slidably positioned to vary the effective length of the tuning stub in a conventional manner to impedance match the input coaxial line with the waveguide/coax junction. This impedance matching technique is useful whenever the narrow dimension of the waveguide is much less than the orthogonal dimension as shown in FIG. 2, which is a schematic illustration of the waveguide 5 in FIG. 1 unfolded to form a rectangular resonant cavity 5'. In FIG. 2, parts are identified by like primed reference numerals. It can be shown for this situation that an impedance match at the coaxial line input is achieved when the following equations are satisfied:

$$\Delta^2\Gamma=\chi, \quad (1)$$

$$\omega^2/Q\,T=Z_o, \quad (2)$$

where $\Delta=\omega^2-\omega_o^2$;

$$\Gamma = \left[ \frac{2\omega}{\left(\Delta^2 + \frac{\omega^4}{Q^2}\right) k(\epsilon a_0 b_0 c_0)^{\frac{1}{2}}} \right] \sin\left(\frac{\pi b_0'}{b_0}\right) \sin\left(\frac{\pi c_0'}{c_0}\right) \cdot \left[ \frac{\sin[k(S_0 + a_0)] - \sin(kS_0)}{\cos[k(S_0 + a_0)]} \right];$$

$a_o$, $b_o$, $c_o$, $b_o'$, $c_o'$, and $S_o$ are defined in FIG. 2; $\chi$ is the probe reactance; $Z_o$ is the characteristic impedance of the coaxial transmission line input; k is the free-space wave number, $\epsilon$ is the vacuum permittivity, and Q is the cavity quality factor.

A careful examination of Eqs. (1) and (2) reveals that these equations may be satisfied over a wide range of values of $\chi$ and $Z_o$ by adjusting the quantities $\Delta$ and $S_o$. The quantity $\Delta$ may be adjusted by changing either $\omega$, the applied frequency, or $\omega_o$, the cavity resonant frequency. The resonant frequency, in turn, may be changed by adjusting the cavity dimensions (a movable backplate for example as will be described herein below). The preferred scheme involves keeping the backplate 13 (FIG. 1) fixed and adjusting the applied frequency and tuning stub length to achieve an impedance match. This scheme has the advantage of simplifying the coupler mechanics considerably and improving its current handling at the back shorting plate since it could be rigidly attached.

Since the wave modes within a folded waveguide are equivalent to those in a simple rectangular waveguide that has been folded several times, an impedance matching/transition scheme like that just described may be used on the folded waveguide coupler as shown in FIG. 1. In this case, the coaxial transmission line input is build into the central vane of the coupler near the back shorting plate 13. In this location, field enhancements resulting from the presence of the short probe segment, formed by coaxial input line center conductor segment between the edge of the vane and the opposite wall of the housing, is small. Since the coax within the center vane is impedance matched, voltages and currents are relatively low (32 KV and 630 A) at 10 megawatts with 50 ohms input impedance. By water cooling the conductors and maintaining a good vacuum between conductors, this section of coax may be made small to minimize perturbation of the waveguide fields.

Alternatively, in applications where the power source frequency may be varied, tests have shown that an impedance match may be obtained at any axial location of the waveguide cavity and the tuning stub length goes to zero, i.e., the sliding short 25 is positioned at the wall of the housing 5, as the coaxial feed position approaches the back wall ($C_o'$ approaches $C_o$, FIG. 2). In this position, the tuning stub may be eliminated altogether by fixing the center conductor 17 to the opposite wall from the vane 7 through which it enters the cavity, further simplifiying the structure under these operating conditions.

Figure 3:
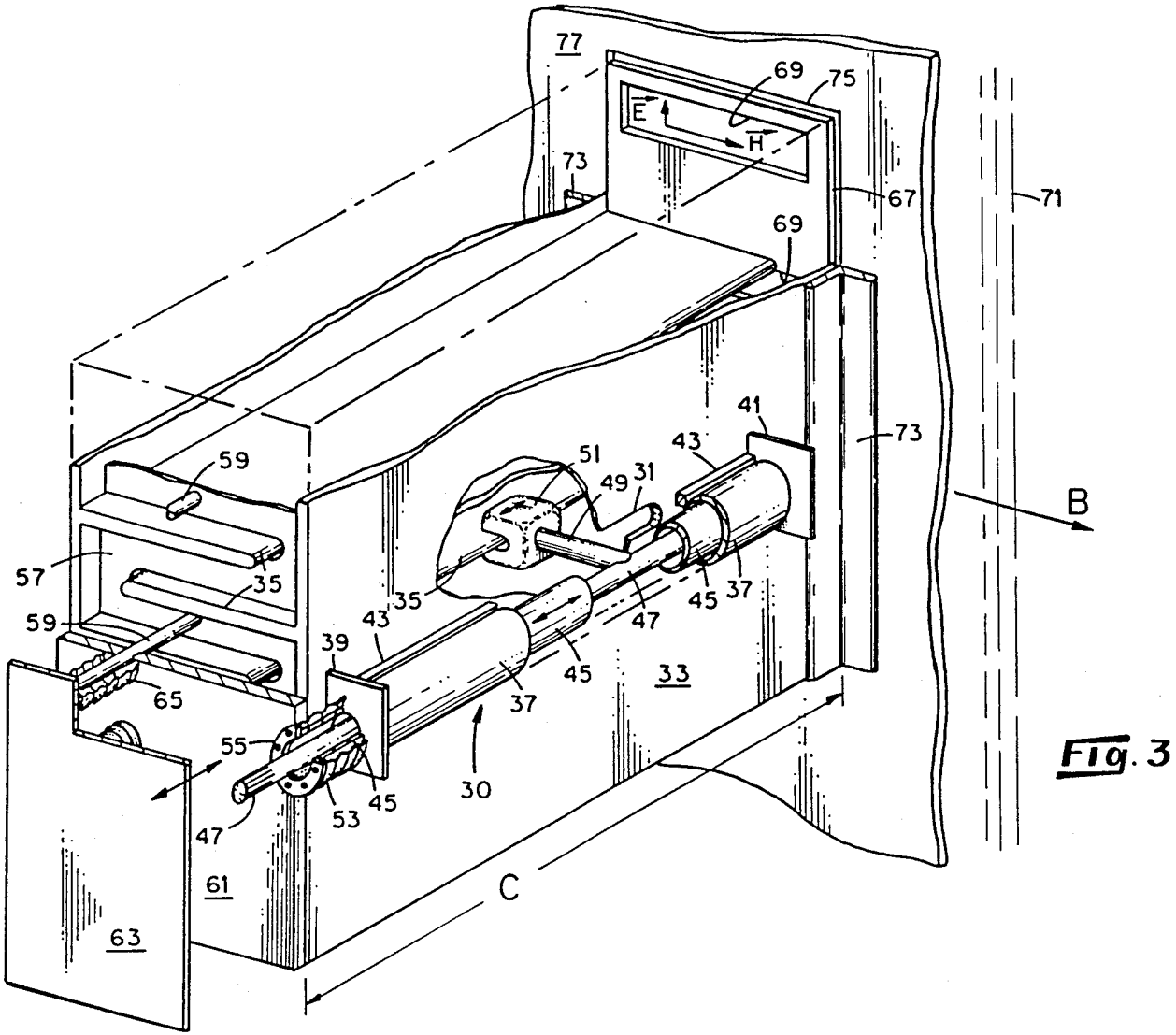
FIG. 3 is a pictorial view of a folded waveguide coupler according to the present invention which is adapted for use at a lower operating frequency than that shown in FIG. 1, requiring more folds, or vanes, to obtain the proper folded cavity dimensions. This embodiment illustrates the vacuum tight connection of a folded waveguide coupler to a vacuum port of a fusion device for ICRH heating of a plasma confined within the vacuum housing. A portion of the waveguide housing has been cut away to illustrate an alternate means of connecting the input coaxial transmission line to provide adjustable positioning of the input feed point for impedance matching and an adjustable rear shorting plate for altering the cavity dimensions.

An alternate means of impedance matching, which is preferred over that shown in FIG. 1, is provided in the embodiment shown in FIG. 3. In this embodiment, the tuning stub is eliminated and replaced by an axially adjustable coaxial input coupling arrangement 30 through a nonradiating slot 31 in the sidewall of a folded waveguide coupler housing 33. The slot is nonradiating by virtue of the fact that it is parallel to the current flow in the walls of the housing 33. The housing 33 is provided with a plurality of interleaved vanes 35 to form a folded waveguide as described above. In this embodiment, the housing 33 is provided with additional vanes to form a longer folded length and is thus operable at lower frequencies than that shown in FIG. 1. Input power is provided through the adjustable position coupler 30 which includes an outer semicircular cylindrical housing 37 that is closed at the ends by plates 39 and 41, respectively. This cylinder is attached to the outside of housing 33, in alignment with the slot 31, by means of mounting bars 43 (only the top bar is shown) sealably welded to the cylinder 37 to form a vacuum tight seal about the slot 31. An input coaxial line, having an outer conductor 45 and an inner conductor 47, is slidably disposed within the cylindrical housing 37. The inner conductor 47 is provided with a tee connection to a short length of inner conductor coupling 49 which attaches to an electrical connector slide block 51. The block 51 has a u-shaped slot which fits about the edge of central vane 35 to form a sliding electrical connection with the vane. The coaxial line is adjusted within the housing 37 to the required axial position necessary to obtain an input impedance match. The inner conductor coupler block 51 moves with the inner conductor 47 to effectively alter the position of the rf power introduction point axially of the guide to obtain the desired impedance match which satisfies the conditions as discussed above.

A vacuum tight seal between the outer conductor 45 of the input coaxial line and the housing 37 is provided by means of a bellows 53 connected between a coupling flange 55 and the end plate 39 about an opening through which the coax outer conductor 45 slidably extends. The space between the inner conductor 47 and the outer conductor 45 is maintained at a vacuum by exposing this volume to the vacuum environment of the housing 33 through an opening (not shown) in the wall of conductor 45 through which the inner conductor coupling 49 extends. A conventional vacuum feedthrough coupling (not shown) may be provided between the input coax line and a coaxial transmission line feeding power to the coupler to provide a vacuum partition in the coxial input line.

The embodiment shown in FIG. 3 has an additional adjustable feature of a movable back plate to aid in obtaining an impedance match between the coupler resonant cavity and the input power line when operating at a fixed input frequency. As discussed above, the cavity resonant frequency may be varied by changing the cavity dimensions to obtain a required difference between the applied frequency and the cavity resonant frequency to satisfy the conditions in Equations 1 and 2 for an impedance match. In this embodiment, the housing axial dimension C is made slightly longer than $\lambda g/2$, as shown in FIG. 1, and the movable back plate 57 is adjusted to obtain the required axial dimension for the particular application.

As shown in FIG. 3, the movable back plate is provided with u-shaped slots which fit about the plurality of vanes 35 in a slidable, electrically contacting arrangement. Slidable, electrical contact with the vanes 35 and the inner walls of the housing 33 may be obtained in various ways as by welding conventional electrical slide connectors (not shown) along all edges of the backing plate which contact the vanes 35 and walls of the housing 33. The preferred slide connector is one referred to as "multiple contact bands," such as the model LAIb/0.15/45° supplied by Hugin Industies, Inc, Los Altos, CA, which is a continuous ribbon of closely spaced, spring-loaded louvers which form the sliding electrical contact by embedding the ribbon in a slot in the movable member so that the louvers are disposed in a gap between the movable member and the fixed member. The slide connector may also consist of "finger contact strips" such as model 97-139-KS supplied by Instrument Specialities, Inc., Delaware Water Gap, PA. In this case, the finger contacts are welded to the moveable member so that the finger contacts are disposed in a gap between the moveable member and the fixed member.

Adjustment of the shorting plate 57 is provided by means of a plurality of positioning rods 59 which are attached at one end to the shorting plate 57 and slidably extend through corresponding apertures in a fixed back plate 61 to a positioning plate 63 located at the back of the coupler. The back plate 61 is sealably attached to the housing 33 to form a vacuum tight sealed back closure for the housing 33. Vacuum seals are provided about the apertures in plate 61 through which rods 59 extend by means of bellows seals 65 connected aboout the rods 59 between the back plate 61 and the positioning plate 63. With these adjustable arrangements of the shorting plate 57 and the input power position an impedance match may be obtained over a variety of operating conditions to obtain maximum power coupling to a confined plasma.

The front of the coupler is covered by a polarizing plate 67 having rectangular apertures 69 aligned with alternate folds of the waveguide coupler so that the magnetic fields of the wave energy launched through the apertures 69 are aligned with the magnetic field B which confines a plasma 71 being heated by the rf wave energy, as pointed out above. The entire coupler assembly is sealably mounted by means of a mounting flange 73 over an access port 75 in a vacuum casing 77 within which the plasma 71 is confined a short distance from the vacuum vessel wall. The coupler is mounted so that the vanes 35 of the coupler are parallel to the magnetic field B of the plasma which provides the proper orientation of the polarized waves launched through the apertures 69 of the polarizing plate 67. The polarizing plate 67 is formed of an electrically conductive material and the openings are precisely formed so that the polarizing plate masks the adjacent vanes thereby producing a unidirectional wave field. Further, the polarizing plate largely eliminates the electric fields that exist at the "bends," or folds, of the coupler structure which are parallel to the field B which confines the plasma 71.

The total H field fringes out into the plasma 71. It is this fringing field that couples power to the plasma that is separated some distance from the vacuum vessel wall 77 and the mouth of the coupler. In the examples illustrated here this distance is assumed to be 10 centimeters. The height of the apertures (narrow dimension) in the polarizing plate is made comparable to or smaller than the distance to the plasma.

As the operating frequency is increased, fewer folds are required. The coupler shown in FIG. 1 is an example of a folded waveguide coupler for use at approximately twice the frequency of the coupler shown in FIG. 3. In each of these devices, the outside dimensions of the coupler housing is 60 cm wide by 70 cm high which corresponds to the vacuum port size of the Tore Supra tokamak fusion device. The overall folded length is obtained by the number of vanes placed in the housing to form the folded waveguide. Thus, it will be seen that devices for various operating frequencies may be designed to fit various sized vacuum ports. Once the operating frequency for an application has been selected, the folded waveguide housing is designed to provide a folded waveguide cutoff frequency well below the operating frequency (typically by a factor of about 1.8). The guide wavelength ($\lambda g$) is then determined as follows:

$$\lambda g = \lambda o/[1-(f_c/f)^2]^{\frac{1}{2}},$$

where $\lambda o$ is the free-space wavelength of the operating frequency, $f_c$ is the waveguide cutoff frequency and f is the operating frequency. The axial dimension of the waveguide is made approximately equal to $\lambda g/2$, as shown in FIG. 1, by placing the back shorting plate at this appropriate dimension. The exact axial dimension of the couplers of FIG. 1 (120 MHz operating frequency) and FIG. 3 (60 MHz operating frequency) depends on various parameters of the folded waveguide and plasma. In particular the axial dimension is determined by the condition that the fields within the plane of the apertures by continuous across the apertures. These design parameters are specific for the Tore Supra tokamak which has a vacuum port size of 60×70 cm, a toroidally confined plasma having a major radius of 225 cm, a minor radius of 70 cm, a toroidal magnetic field B of approximately 40 kilo gauss, a plasma/coupler separation of 10 cm, and 10 megawatts of input power. The waveguide housing of each coupler is formed of aluminum.

TABLE

| Parameters | 120-MHz Coupler (four folds) | 60-MHz Coupler (eight folds) |
|---|---|---|
| Electric field in coupling apertures | 2.3 KV/cm | 1.6 KV/cm |
| Peak electric field within the guide | 20 KV/cm | 42 KV/cm |
| Plasma loaded quality factor ($Q_L$) | 213 | 904 |
| Unloaded quality factor ($Q_u$) | 23,440 | 9,770 |
| Power coupling efficiency ($E = Q_u/(Q_u + Q_L)$) | 99% | 92% |
| Coupler length | 144.7 cm | 291.45 cm |

Thus, it will be seen that a means has been provided for efficiently coupling multimegawatts of power into the fast magnetosonic wave within a plasma for ICRH of high power fusion devices based on a folded waveguide coupler. The folded coupler cavity allows the power to be coupled to the plasma through limited vacuum port sizes as compared to other power coupling devices.

Figure 4:
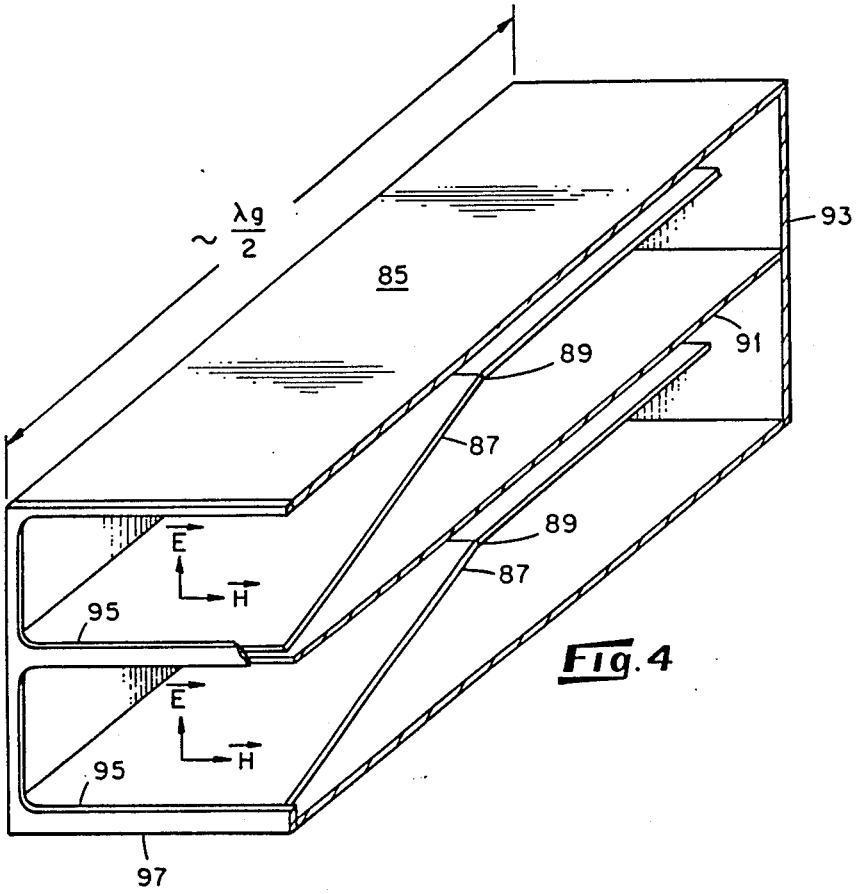
FIG. 4 is a sectioned pictorial view of an alternate folded waveguide cavity having tapered vanes.

Although the invention has been described by means of specific preferred embodiments, various modification and changes may be made therein without departing from the scope of the invention as defined in the appended claims. For example, the folded waveguide may be altered as shown in FIG. 4 to provide a tapered-vane, folded waveguide a cavity. As shown, the waveguide housing 85, which has been sectioned to show the tapered vane structure, is provided with alternate taped vanes 87 which taper in two planes from a point 89 approximately midway of the axial dimension of the vane to a line at the mouth of the coupler parallel to, and spaced from, the adjacent planar vane 91. The planar vane 91 is connected to the opposite wall (not shown) of the housing from the tapered vanes 87 to provide the interleaved array required to form the folded waveguide as described above with reference to FIG. 1. In this way, the regions of the coupler mouth which radiate power through corresponding apertures 95 in a polarizing plate 97 covering the mouth of the coupler can be enlarged to nearly the entire area of the coupler mouth. This results in a lower power flux at the plasma/coupler interface for a given total power radiated when compared to the simpler folded waveguide couplers of FIGS. 1 and 3. In addition, by enlarging the poloidal (vertical) coverage of the wave fields at the mouth of the coupler, more power will be contained in low values of the poloidal wave number spectrum. This results in better penetration of wave power into the plasma core compared to the simple folded waveguide structure. A shorting plate 93 forms the back of the housing 85 and is located at a distance of approximately $\lambda g/2$ from the front polarizing plate. Further, depending on the application and the number of vanes necessary for the application, each vane may be tapered to obtain the desired results.

Figure 5:
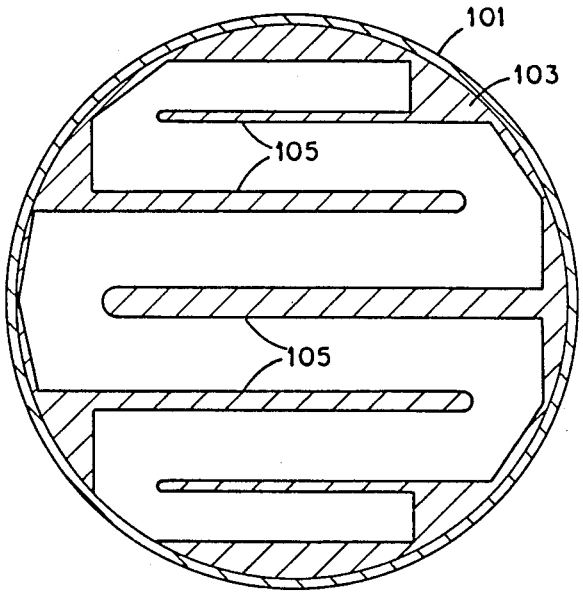
FIG. 5 is a front view of a circular cross section folded waveguide cavity which may be substituted for the rectangular cavity shown in FIG. 1 in a coupler according to the present invention.

Alternatively, the folded waveguide coupler technique disclosed herein may also be embodied in a circular waveguide, as shown in FIG. 5, to fit a circular vacuum port of a plasma confinement housing. A circular waveguide housing 101 is provided with an insert 103 machined from an electrically conductive material to form a generally rectangular folded waveguide by providing parallel interleaved vanes 105 within the structure similar to that shown in FIG. 1.

As pointed out above, the spacing between vanes may be varied to increase toward the center of the mouth of the coupler. The unfolded equivalent to this configuration approaches the configuration of an elliptical cross-section waveguide. Since most of the power flux occurs in the central region of the coupler cross section, enlarging the vane spacing near the center of the coupler and the radius of the vane edges increases the power handling of this and other disclosed embodiments of the coupler substantially.

What is claimed is:

1. A waveguide coupler for coupling rf energy at a selected operating frequency into a magnetically confined plasma within a vacuum vessel, comprising:

an electrically conductive housing having a front opening attached to a vacuum port of said vacuum vessel, a back opening, and a plurality of vanes disposed in an interleaved spaced array from opposing walls of said housing and extending axially of said housing from said front opening to said back opening thereof to form a folded, generally rectangular resonant waveguide cavity with said plurality of vanes of said housing disposed parallel to the magnetic fields confining said plasma and having a cutoff frequency substantially below said selected operating frequency and wherein the distance between the edges of said plurality of vanes is substantially equal to the distance between adjacent ones of said plurality of vanes;

an electrically conductive polarizing plate disposed over said front opening of said housing and having a plurality of rectangular openings aligned with selected alternate folds of said housing for selective propagation therethrough of rf waves having a common polarization for selective coupling of wave energy to the fast magnetosonic wave of said plasma;

an electrically conductive shorting plate means disposed over said back opening of said housing and spaced from the front opening a distance which produces maximum power transfer of rf wave energy into said plasma for establishing a wave pattern within said cavity having a small electric field component and a large magnetic field component at the apertures of said polarizing plate attached to the front of said housing to provide substantially magnetic field coupling of wave energy propagating through said polarizing plate into said plasma located adjacent to and spaced from the front of said housing; and a transition connector means for introducing rf power at said operating frequency from a coaxial transmission line into said folded waveguide cavity formed by said housing at a transition junction providing an impedance match with said coaxial transmission line.

2. The waveguide coupler as set forth in claim 1 wherein said housing is rectangular in cross section.

3. The waveguide coupler as set forth in claim 2 wherein said transition connector means includes a coaxial coupler having an inner conductor probe segment for connection to the inner conductor of a coaxial transmission line and extending through an opening in a centralmost one of said plurality of vanes of said housing perpendicular from one sidewall of said housing into said folded waveguide cavity parallel to said vanes and a coaxial tuning stub having an outer conductor connected to the sidewall of said housing opposite said one sidewall thereof at an opening therein aligned with said opening in said centralmost vane and an inner conductor connected to said inner conductor probe of said transition connector, so that an impedance match may be obtained between the coaxial transmission input line and said transition connector means to maximize rf power transmission into said folded waveguide cavity by said inner conductor probe segment.

4. The waveguide coupler as set forth in claim 2 wherein said transition connector means includes a conductor probe segment connected at one end to the inner conductor of said coaxial transmission line and extending through a nonradiating slot in one sidewall of said housing in parallel alignment with the inward edge of a central most one of said plurality of vanes extending from the sidewall of said housing opposite said one sidewall, an electrically conductive slide means connected to the opposite end of said conductor probe segment and adapted for sliding electrical connection with said inward edge of said centralmost one of said plurality of vanes, and means for positioning said conductor probe segment along said inward edge of said centralmost one of said vanes to obtain an impedance matched connection of said coaxial transmission line to said folded waveguide cavity.

5. The waveguide coupler as set forth in claim 4 wherein said shorting plate means includes an electrically conductive member slidably disposed in said back opening of said housing for sliding electrical connection with said plurality of vanes and the sidewalls of said housing and means coupled with said electrically conductive member for selectively positioning said member along the axis of said folded waveguide cavity to vary the effective dimensions of said cavity and thereby alter the resonant frequency of said cavity to further aid impedance matching of said cavity to said transmission line input.

6. The waveguide coupler as set forth in claim 1 wherein alternate ones of said plurality of interleaved vanes are tapered along two planes from a point on the inward extending edge thereof at a selected distance from the front end of said housing toward the front end forming alternate enlarged radiating areas for the selected radiating folds of said cavity and wherein said openings in said polarizing plate are enlarged to correspond to the enlarged radiating areas provided by the tapered vanes.

7. The wave guide coupler as set forth in claim 1 wherein said housing is circular in cross section.

8. The wave guide coupler as set forth in claim 1 wherein said plurality of vanes are spaced within said housing at larger intervals near the central region of the cross section of said housing compared to the outer regions thereof and wherein the thickness of the vanes and the radius of the vane edges increases towards said central region of said housing for reducing the magnitude of the electric fields within the waveguide coupler for a selected total power operating level.

9. The waveguide coupler as set forth in claim 1 wherein said selected operating frequency is in the range of from about 50–200 MHz.

* * * * *